US012791233B2

(12) United States Patent
Arumugam et al.

(10) Patent No.: US 12,791,233 B2
(45) Date of Patent: Nov. 10, 2026

(54) SYSTEM AND METHOD FOR DECOUPLING LOW-TEMPERATURE (LT) AND MEDIUM-TEMPERATURE (MT) COMPRESSORS

(71) Applicant: Heatcraft Refrigeration Products LLC, Stone Mountain, GA (US)

(72) Inventors: Suyambu Lingam Arumugam, Tamil Nadu (IN); Shitong Zha, Snellville, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 123 days.

(21) Appl. No.: 18/999,487

(22) Filed: Dec. 23, 2024

(65) Prior Publication Data

US 2026/0177297 A1 Jun. 25, 2026

(51) Int. Cl.

| | |
|---|---|
| ***F25B 31/00*** | (2006.01) |
| ***F25B 9/00*** | (2006.01) |
| ***F25B 43/02*** | (2006.01) |
| ***F25B 49/02*** | (2006.01) |

(52) U.S. Cl.

CPC ..... *F25B 31/004* (2013.01); *F25B 9/008* (2013.01); *F25B 43/02* (2013.01); *F25B 49/022* (2013.01); *F25B 2309/06* (2013.01); *F25B 2600/0253* (2013.01); *F25B 2700/1933* (2013.01)

(58) Field of Classification Search

CPC ..... F25B 31/004; F25B 9/008; F25B 43/02; F25B 49/022; F25B 2309/06; F25B 2600/0253; F25B 2700/1933

See application file for complete search history.

(56) References Cited

U.S. PATENT DOCUMENTS

| | | | | |
|---|---|---|---|---|
| 11,287,168 | B2 * | 3/2022 | Martin | F25B 1/10 |
| 2023/0408166 | A1 * | 12/2023 | Zha | F25B 41/20 |
| 2023/0408167 | A1 * | 12/2023 | Zha | F25B 5/02 |

* cited by examiner

*Primary Examiner* — Emmanuel E Duke
(74) *Attorney, Agent, or Firm* — Baker Botts L.L.P.

(57) ABSTRACT

A refrigeration system includes an indoor heat exchanger configured to receive refrigerant from a flash tank and provide air conditioning to a target space by transferring heat between the refrigerant and the target space. A low-temperature (LT) compressor positioned downstream of the indoor heat exchanger receives and compresses the refrigerant from the indoor heat exchanger. An oil separator downstream of the LT compressor separates oil from the refrigerant and circulates it back to the LT and medium-temperature (MT) compressors. A check valve downstream of the oil separator allows refrigerant to flow to an internal heat exchanger, which transfers heat from refrigerant discharged from the LT compressor to refrigerant received from the flash tank. The MT compressor positioned downstream of the internal heat exchanger compresses the refrigerant, and an outdoor heat exchanger downstream of the MT compressor transfers heat from the refrigerant to the surrounding environment.

20 Claims, 2 Drawing Sheets

SYSTEM AND METHOD FOR DECOUPLING LOW-TEMPERATURE (LT) AND MEDIUM-TEMPERATURE (MT) COMPRESSORS

TECHNICAL FIELD

This disclosure relates generally to refrigeration systems. More particularly, this disclosure relates to the system and method for decoupling low-temperature (LT) and medium-temperature (MT) compressors.

BACKGROUND

Cooling systems are used to cool spaces, such as residential dwellings, commercial buildings, and/or refrigeration units. These systems cycle a refrigerant (also referred to as charge) that is used to cool the spaces.

SUMMARY OF THE DISCLOSURE

A conventional carbon dioxide ($CO_2$) refrigeration system may include a medium-temperature (MT) and a low-temperature (LT) compressor to provide cooling for different applications. In conventional refrigeration systems, the LT compressor compresses the refrigerant from low-temperature applications (e.g., freezers in a store), while the MT compressor handles medium-temperature applications (e.g., for display cases). In some conventional refrigeration systems, the discharge line of the LT compressor is connected directly to the suction line of the MT compressor. The MT compressor may receive multiple refrigerant streams from the flash tank and the LT compressor. Such designs may introduce several drawbacks. For example, some conventional designs may lead to having four distinct pressure levels to control and manage, where the four pressure levels include the refrigerant's pressure at the MT compressor's discharge line, the refrigerant's pressure at the flash gas tank, the refrigerant's pressure at the MT compressor's suction line, and the refrigerant's pressure at the LT compressor's suction line. Controlling and managing these pressure levels may add to the complexity of the system design, and make the design and troubleshooting more difficult. In another example, with some conventional designs of direct coupling between the LT and MT compressors, the refrigerant discharged from the LT compressor may be at a temperature that is too high for the MT compressor to handle (e.g., compress). Therefore, the MT compressor may experience a high suction superheat and subsequently the overall discharge temperature may increase. In order to reduce the MT compressor suction temperature, the flash gas from the flash tank may be expanded through the flash gas bypass valve, mixed with the LT compressor discharge, and reduce the temperature at MT compressor suction. This may lead to an increase in power consumption and energy of the MT compressor, since the flash gas required to be re-compressed from the MT suction pressure instead of flash tank pressure. In another example, in some conventional refrigeration systems, the oil separator may be positioned downstream of the MT compressor. However, the high-temperature refrigerant that is discharged from the MT compressor may require thicker materials (such as vessels) for the oil separator, so that the oil separator can efficiently separate the oil from the refrigerant. This adds to the complexity of the oil separator design.

The disclosed system provides a solution to these and other technical problems of conventional refrigeration systems. The disclosed refrigeration system is configured to decouple the MT and LT compressors. Therefore, the LT compressor's discharge line is not directly connected to the suction line of the MT compressor. This solution provides several technical advantages. For example, with the decoupling of the MT and LT compressors, the pressure levels at the discharge line of the LT compressor, the flash tank, and the suction line of the MT compressor may be configured to be substantially the same or similar to each other, and therefore, controlled together. Therefore, the number of data points (e.g., pressure levels) that need to be controlled is reduced. This solution reduces the complexity of the system design and makes the troubleshooting easier.

In some embodiments, the disclosed system decouples the MT and LT compressors by introducing a check valve between the LT compressor and the flash tank to maintain the target pressure differential between the MT and LT compressors' suction lines for oil injection back into the compressors. This, in turn, allows oil to flow from the oil separator to the MT compressor suction.

The disclosed refrigeration system positions the oil separator downstream of the LT compressor so that it receives refrigerant at a lower temperature than it would in some conventional systems where the oil separator is positioned downstream of the MT compressor. The lower operating temperature and pressure for the oil separator allows for a simpler design and obviates the need for thicker materials (e.g., vessels) for the oil separator.

The disclosed system solves the issue of the MT compressor receiving, and being burdened by, multiple refrigerant streams simultaneously by separating the flow paths of the refrigerant streams. This, in turn, reduces the complexity of controlling and operating the system, and the energy that would otherwise be spent by the MT compressor to compress the refrigerant from multiple streams with different temperatures and pressures. Accordingly, in some embodiments, the disclosed system reduces the thermal load on the MT compressor, which increases the efficiency and reduces the power consumption of the MT compressor.

In some embodiments, the disclosed refrigeration system may include an indoor positioned downstream of a flash tank, and configured to receive refrigerant from the flash tank; and provide air conditioning to a target space by transferring heat between the refrigerant and the target space. The refrigeration system may further include an LT compressor positioned downstream of the indoor heat exchanger, and configured to receive the refrigerant from the indoor heat exchanger; and compress the refrigerant received from the indoor heat exchanger. The refrigeration system may further include an oil separator positioned downstream of the LT compressor, and configured to receive the refrigerant from the LT compressor; separate oil from the refrigerant received from the LT compressor; and circulate the separated oil back to the LT compressor and a medium-temperature (MT) compressor. The refrigeration system may further include a check valve positioned downstream of the oil separator, and configured to allow a flow of the refrigerant from the oil separator toward an internal heat exchanger. The refrigeration system may further include the internal heat exchanger positioned downstream of the check valve, and configured to transfer heat from the refrigerant discharged from the LT compressor to the refrigerant received from a flash tank. The refrigeration system may further include the flash tank positioned downstream of the check valve, and configured to store a mixture of the refrigerant in vapor form and liquid form, wherein the refrigerant in vapor form is provided to the internal heat exchanger and the refrigerant in liquid form is provided to the indoor heat exchanger. The refrigeration system may further include the MT compressor positioned downstream of the internal heat exchanger, and configured to receive the refrigerant from the internal heat exchanger; and compress the refrigerant received from the internal heat exchanger; and an outdoor heat exchanger positioned downstream of the MT compressor, and configured to transfer heat from the refrigerant discharged from the MT compressor to surrounding environment.

Certain embodiments of the present disclosure may include some, or none of these advantages. These advantages and other features will be more clearly understood from the following detailed description taken in conjunction with the accompanying drawings and claims.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
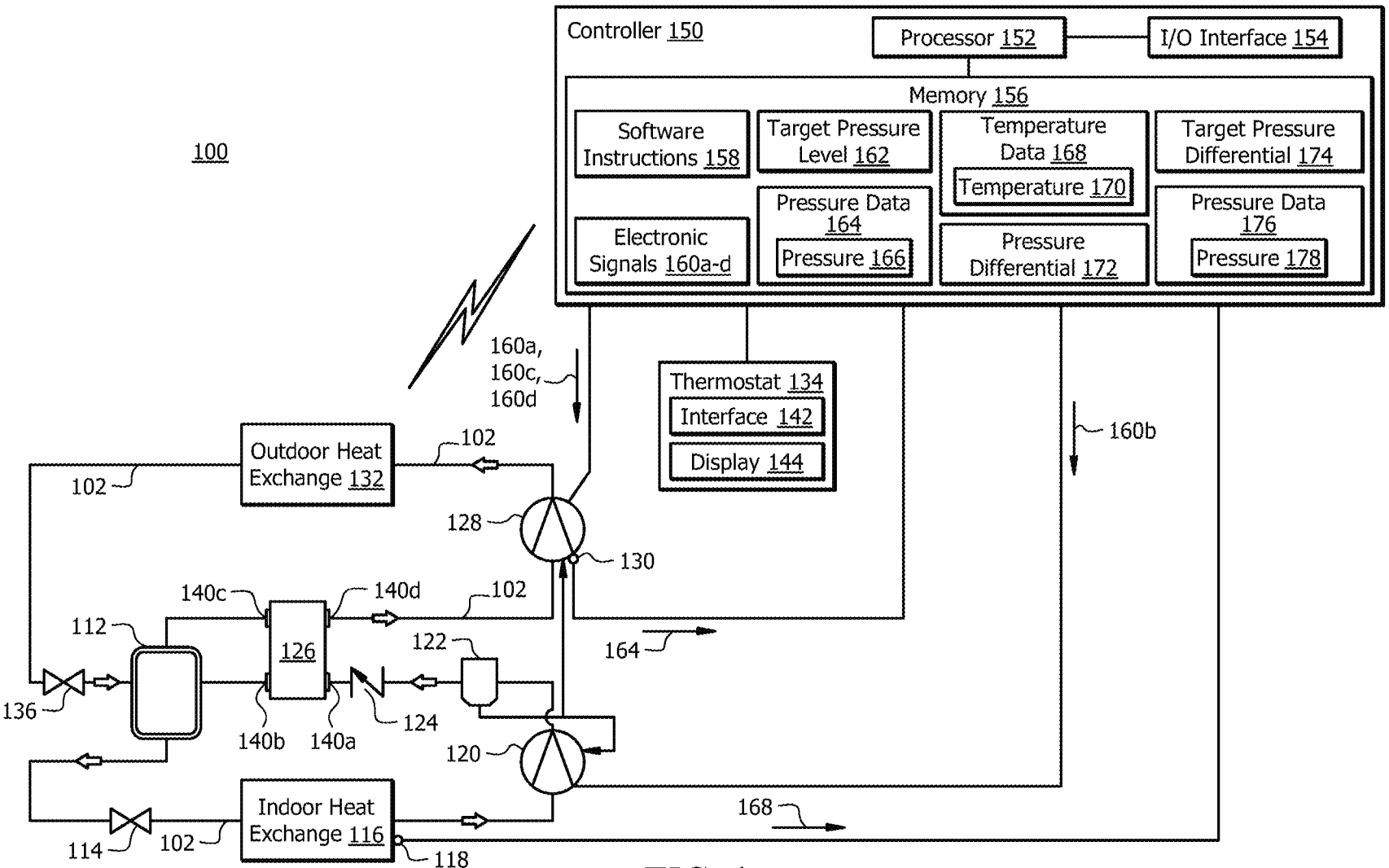
FIG. 1 illustrates a diagram of an embodiment of a refrigeration system, according to some embodiments of the present disclosure.
Figure 2:
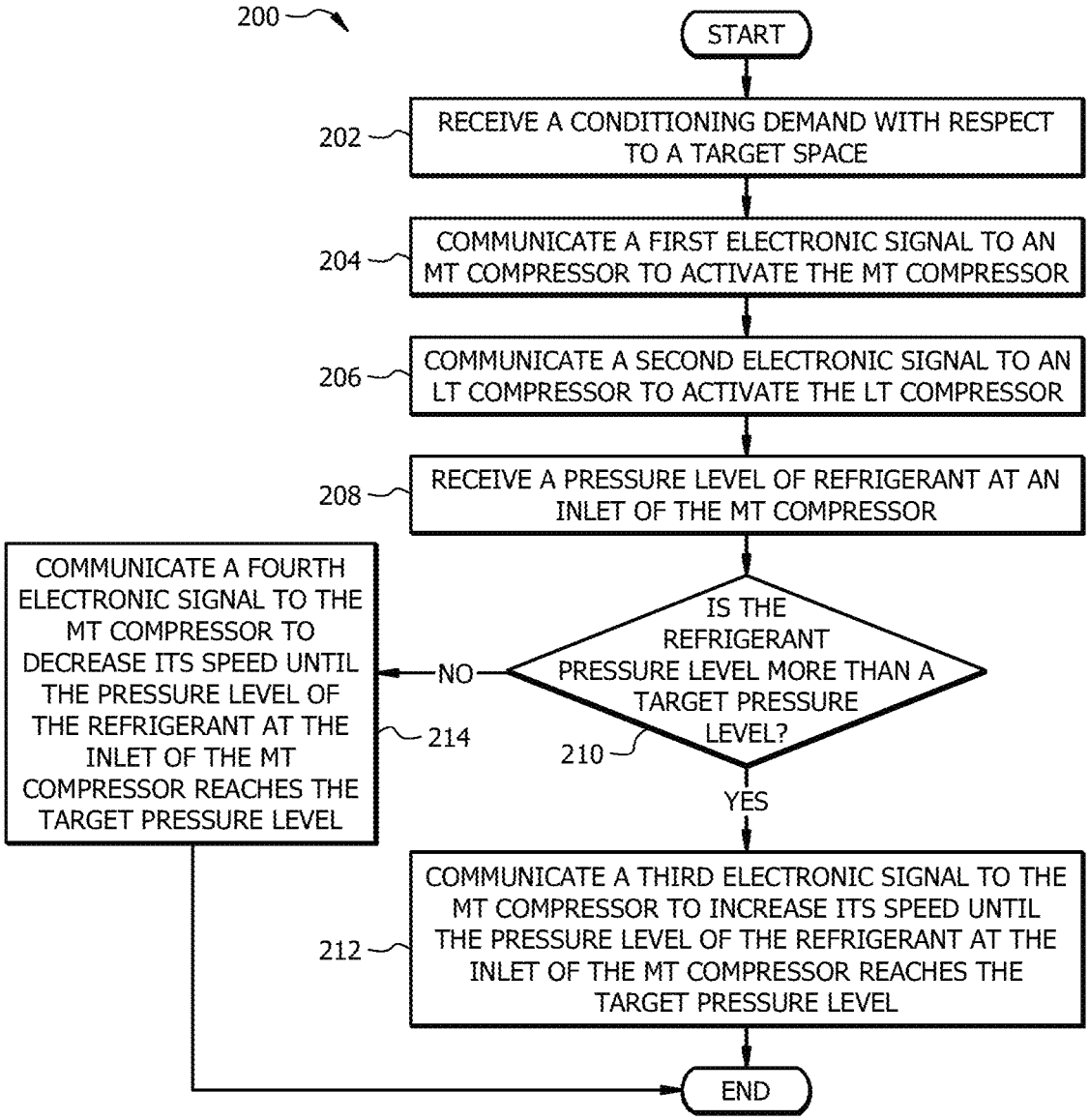
FIG. 2 illustrates a flowchart of an example method of operating the refrigeration system of FIG. 1.

Embodiments of the present disclosure and its advantages are best understood by referring to FIGS. 1 through 2 of the drawings, like numerals being used for like and corresponding parts of the various drawings.

The conventional carbon dioxide ($CO_2$) refrigeration systems may include a medium-temperature (MT) and a low-temperature (LT) compressor to provide cooling for different applications. In conventional refrigeration systems, the LT compressor compresses the refrigerant from low-temperature applications (e.g., freezers in a store), while the MT compressor handles medium-temperature applications (e.g., for display cases). In some conventional refrigeration systems, the discharge line of the LT compressor is connected directly to the suction line of the MT compressor. The MT compressor may receive multiple refrigerant streams from the flash tank and the LT compressor. Such designs may introduce several drawbacks. For example, some conventional designs may lead to having four distinct pressure levels to control and manage, where the four pressure levels include the refrigerant's pressure at the MT compressor's discharge line, the refrigerant's pressure at the flash gas tank, the refrigerant's pressure at the MT compressor's suction line, and the refrigerant's pressure at the LT compressor's suction line. Controlling and managing these pressure levels may add to the complexity of the system design, and make the design and troubleshooting more difficult. In another example, with some conventional designs of direct coupling between the LT and MT compressors, the refrigerant discharged from the LT compressor may be at a temperature that is too high for the MT compressor to handle (e.g., compress). Therefore, the MT compressor may experience a high suction superheat and subsequently the overall discharge temperature may increase. In order to reduce the MT compressor suction temperature, the flash gas from the flash tank may be expanded through the flash gas by pass valve, mixed with the LT compressor discharge, and reduce the temperature at MT compressor suction. This may lead to an increase in power consumption and energy of the MT compressor, since the flash gas required to be re-compressed from the MT suction pressure instead of flash tank pressure In another example, in some conventional refrigeration systems, the oil separator may be positioned downstream of the MT compressor. However, the high-temperature refrigerant that is discharged from the MT compressor may require thicker materials (such as vessels) for the oil separator, so that the oil separator can efficiently separate the oil from the refrigerant. This adds to the complexity of the oil separator design. The disclosed system provides a solution to these and other technical problems of conventional refrigeration systems. The disclosed refrigeration system is configured to decouple the MT and LT compressors. Therefore, the LT compressor's discharge line is not directly connected to the suction line of the MT compressor. This solution provides several technical advantages. For example, with the decoupling of the MT and LT compressors, the pressure levels at the discharge line of the LT compressor, the flash tank, and the suction line of the MT compressor may be configured to be substantially the same or similar to each other, and therefore, controlled together. Therefore, the number of data points (e.g., pressure levels) that need to be controlled is reduced. This solution reduces the complexity of the system design and makes the troubleshooting easier.

In some embodiments, the disclosed system decouples the MT and LT compressors by introducing a check valve between the LT compressor and the flash tank to maintain the target pressure differential between the MT and LT compressors' suction lines for oil injection back into the compressors. This, in turn, allows oil to flow from the oil separator to the MT suction.

The disclosed refrigeration system positions the oil separator downstream of the LT compressor so that it receives refrigerant at a lower temperature than it would in some conventional systems where the oil separator is positioned downstream of the MT compressor. The lower operating temperature and pressure for the oil separator allows for a simpler design and obviates the need for thicker materials (e.g., vessels) for the oil separator.

The disclosed system solves the issue of the MT compressor receiving, and being burdened by, multiple refrigerant streams simultaneously by separating the flow paths of the refrigerant streams. This, in turn, reduces the complexity of controlling and operating the system, and the energy that would otherwise be spent by the MT compressor to compress the refrigerant from multiple streams with different temperatures and pressures. Accordingly, in some embodiments, the disclosed system reduces the thermal load on the MT compressor, which increases the efficiency and reduces the power consumption of the MT compressor.

Refrigeration System

FIG. 1 illustrates an example refrigeration system 100 according to an embodiment of the present disclosure. In general, the refrigeration system 100 is configured to decouple LT and MT compressors. In some embodiments, the refrigeration system 100 comprises refrigerant conduit subsystems 102, a flash tank 112, a valve 114, an indoor heat exchanger 116, a temperature sensor circuit 118, an LT compressor 120, an oil separator 122, a check valve 124, an internal heat exchanger 126, an MT compressor 128, a pressure sensor circuit 130, an outdoor heat exchanger 132, a thermostat 134, a valve 136, and a controller 150. In some embodiments, the refrigeration system 100 is a transcritical refrigeration system that circulates a working fluid or charge, such as a transcritical refrigerant (e.g., $CO_2$). The illustrated embodiment of the refrigeration system 100 in FIG. 1 is configured to provide air conditioning for one or more target spaces for one or more applications, such as low-temperature applications (e.g., freezing applications) and medium-temperature applications (e.g., for display cases). In some embodiments, the refrigeration system 100 may include one or more of each of the illustrated components operably coupled to one another. In some embodiments, the refrigeration system 100 may include additional components.

System Components

The refrigerant conduit subsystems 102 facilitate the movement of a refrigerant (also referred to herein as a working fluid) through a refrigeration cycle such that the working fluid flows as illustrated by arrows in FIG. 1. The refrigerant conduit subsystem 102 includes any conduit, tubing and the like that is illustrated in FIG. 1 fluidly connecting components of the refrigeration system 100.

The flash tank 112 may generally be a storage component to store refrigerant in vapor and liquid forms. The flash tank 112 is fluidly coupled to the refrigerant conduit subsystem 102 and is positioned downstream of the outdoor heat exchanger 132 (via the valve 136), the check valve 124, and the internal heat exchanger 126 (via the outlet 140*b* of the internal heat exchanger 126). The flash tank 112 may be configured to separate the refrigerant into a vapor refrigerant and a liquid refrigerant. Typically, the vapor refrigerant collects near the top of the flash tank 112 and the liquid refrigerant is collected at the bottom of the flash tank 112. In some embodiments, during providing conditioning according to a conditioning demand, the liquid refrigerant flows from flash tank 112 toward the indoor heat exchanger 116. Additionally, the vapor refrigerant (gas) flows from the flash tank 112 toward the internal heat exchanger 126 (at the inlet 140*c*) to facilitate heat exchange between the vapor refrigerant and the refrigerant flown from the check valve 124 to reduce the temperature of the refrigerant flowing into the MT compressor 128.

The valve 114 may generally be an expansion valve, a flow control valve, a flash gas valve, a solenoid valve, a motorized valve, a check valve, an electronic expansion valve (EEV), a thermal expansion valve (TXV), and the like. The valve 114 may be positioned in the refrigerant conduit subsystem 102 and located in a portion of the refrigerant conduit subsystem 102 that connects the flash tank 112 to the indoor heat exchanger 116. The valve 114 may be fluidly coupled to the refrigerant conduit subsystem 102. The controller 150 may be in signal communication with the valve 114 (e.g., via wired and/or wireless communication) and control its operation by sending electronic signals to the valve 114, in the example when an EEV is implemented for valve 114. The valve 114 is configured to open and close by varying degrees to control the flow of the refrigerant discharged from flash tank 112 toward the indoor heat exchanger 116.

The indoor heat exchanger 116 may generally include one or more indoor evaporator coils and fans to move air across the coils. The indoor heat exchanger 116 is fluidly coupled to the refrigerant conduit subsystems 102 and positioned downstream of the flash tank 112 and the valve 114. The first indoor heat exchanger 116 is in signal communication with the controller 150 using wired and/or wireless connections. The controller 150 may send control signals to the indoor heat exchanger 116 to control the speed of the fans based on temperature conditions and the cooling demand. The indoor heat exchanger 116 may be configured to receive the refrigerant from the flash tank 112 and absorb heat from the surrounding environment via the refrigerant received from the flash tank 112. The indoor heat exchanger 116 may function as an evaporator. When the refrigerant reaches the indoor heat exchanger 116, the refrigerant absorbs heat from the surrounding air in the target indoor space and releases cooled or conditioned air into the target space. For example, the refrigerant cools metallic components (e.g., metallic coils, plates, and/or tubes) of the indoor heat exchanger 116 as the refrigerant passes through them. These metallic components may then cool the air around them. The cooled air may then be circulated such as, for example, by a fan to cool a space such as, for example, a freezer and/or a refrigerated shelf. Therefore, the indoor heat exchanger 116 may provide air conditioning to the target space by transferring heat between the refrigerant and the target space.

The temperature sensor circuit 118 may include a temperature sensing element and circuitry. The temperature sensor circuit 118 may be implemented by a hardware circuit and configured to detect the temperature 170 of the target space that requires conditioning. The temperature sensor circuit 118 may include one or more temperature sensor circuit 118. The temperature sensor circuit 118 may include a temperature sensing element such as a thermocouple, a thermistor, a semiconductor-based temperature circuit board, or any other type of temperature sensor. In some examples, the temperature sensor circuit(s) 118 may be positioned upstream and/or downstream of the indoor heat exchanger 116, within the target space, or at any other location. The temperature sensor circuit 118 may be attached to a surface and/or the indoor heat exchanger 116 using any appropriate means (e.g., threaded connections, clamps, adhesives, or the like). The temperature sensor circuit 118 is configured to detect the temperature 170 of the target space periodically (e.g., every second, every minute, etc.) and/or on demand (e.g., in response to a request from a user provided to the controller 150 or a control panel). The temperature sensor circuit 118 is in signal communication with the controller 150 using wired and/or wireless connections. The temperature sensor circuit 118 may provide the detected temperature data 168 (which includes the detected temperature 170) to the controller 150. The controller 150 may use the temperature data 168 for evaluating the system conditions. This process is described further below in conjunction with the operational flow of the system 100 in greater detail.

The LT compressor 120 may be a variable speed compressor or a multiple-stage compressor and generally configured to compress (e.g., increase the pressure of) the refrigerant received from the indoor heat exchanger 116. The LT compressor 120 may be configured to compress refrigerant from low-temperature applications, such as freezers, by increasing the refrigerant pressure. The LT compressor 120 is fluidly coupled with the refrigerant conduit subsystem 102 and may be positioned downstream of the indoor heat exchanger 116. The LT compressor 120 may be configured to compress the refrigerant received from the indoor heat exchanger 116. The LT compressor 120 is in signal communication with the controller 150 using wired and/or wireless connections. The controller 150 may communicate electronic signals to the LT compressor 120 to control its speed. A variable-speed compressor is generally configured to operate at different speeds to increase the pressure of the refrigerant to keep the refrigerant moving along the fluid conduit subsystem 102. In the variable-speed compressor configuration, the speed of LT compressor 120 can be modified to adjust the cooling capacity and/or load of the refrigeration system 100. Meanwhile, in the multi-stage compressor configuration, one or more compressors can be turned on or off to adjust the cooling capacity of the refrigeration system 100. In some embodiments, the controller 150 may control the speed of the LT compressor 120 via a variable speed drive component that is configured to translate electronic control signals into frequency adjustments (e.g., in terms of Hertz). For example, the variable speed drive component receives signals from the controller 150 to increase or decrease the frequency of the electrical power supplied to the LT compressor 120, which in turn regulates the compressor's speed. The variable speed drive may be a part of or communicatively coupled to the controller 150 and implemented by the processor 152 executing the software instructions 158 to perform its functions.

The oil separator 122 is generally a component that is configured to separate oil from the refrigerant. The oil separator 122 may separate oil from the refrigerant discharged from the LT compressor 120 and return (or circulate) the separated oil back to the LT compressor 120 and the MT compressor 128. In some examples, the oil separator 122 may be a coalescing oil separator, centrifugal oil separator, or any other type. For example, the coalescing oil separator may include mesh-shaped filters to separate oil from the refrigerant to merge into larger oil droplets, which cannot pass through the mesh. In another example, the centrifugal oil separator separates the oil from the refrigerant by spinning the oil-refrigerant mixture to use the centrifugal force to cause the oil to move outward and be separated from the refrigerant. The oil separator 122 is fluidly coupled to the refrigerant conduit subsystem 102 and positioned downstream of the LT compressor 120. The oil separator 122 separates the oil from the refrigerant before it enters other downstream components. The oil may be introduced to certain components of system 100, such as the LT compressor 120 and MT compressor 128 for lubrication of the interior of the compressors. In some occasions, the oil may be mixed with the refrigerant as it passes through the compressor. By separating out the oil, the efficiency of outdoor heat exchanger 132 is maintained. If the oil separator 122 were not present, then the oil (mixed with the refrigerant) may clog any of the heat exchangers, such as the indoor heat exchanger 116, the outdoor heat exchanger 132, and/or the internal heat exchanger 126, which may reduce the refrigerant's ability to absorb or release heat in the heat exchangers, which leads to the heat transfer efficiency of system 100 being reduced.

The check valve 124 may generally be an expansion valve, a flow control valve, a flash gas valve, a solenoid valve, a motorized valve, an electronic expansion valve (EEV), a thermal expansion valve (TXV), and the like. The check valve 124 may be positioned in the refrigerant conduit subsystem 102 and located in a portion of the refrigerant conduit subsystem 102 that connects the oil separator 122 to the internal heat exchanger 126. The check valve 124 may be fluidly coupled to the refrigerant conduit subsystem 102 and positioned downstream of the oil separator 122. The controller 150 may be in signal communication with the check valve 124 (e.g., via wired and/or wireless communication) and control its operation by sending electronic signals to the check valve 124, in the example when an EEV is implemented for check valve 124. The check valve 124 is configured to open and close to control the flow of the refrigerant discharged from the oil separator 122 and the LT compressor 120. The check valve 124 may be a unidirectional valve that prevents the flow of the refrigerant back to the oil separator 122. The check valve 124 may maintain the target pressure differential 174 (e.g., 1 bar, 2 bars, etc.; 14.50 pounds per square inch (PSI), 29.01 PSI, etc.; or 0.1 megapascal (MPa), 0.2 MPa, etc.) between the suction line of the MT compressor 128 and the discharge line of the LT compressor 120. For example, the check valve 124 may be pre-configured according to the target pressure differential 174 and operate to maintain the target pressure differential 174.

The internal heat exchanger 126 may generally be a plate heat exchanger, a shell and tube heat exchanger, a coaxial heat exchanger, or a finned-tube heat exchanger, among others. The internal heat exchanger 126 may be fluidly coupled to the refrigerant conduit subsystems 102 and positioned downstream of the flash tank 112 and the check valve 124 and upstream of the MT compressor 128. The internal heat exchanger 126 may be configured to transfer heat from the refrigerant discharged from the LT compressor 120 to the refrigerant received from the flash tank 112. To this end, the internal heat exchanger 126 may receive vapor refrigerant from the flash tank 112 (via the inlet 140*c*), which has a low temperature (due to the pressure reduction in the flash tank 112), and refrigerant flown from the check valve 124 (via the inlet 140*a*), which has a higher temperature due to its recent compression by the LT compressor 120. This cools down the warmer refrigerant received from the check valve 124, which reduces the superheat of the refrigerant entering the flash tank and provides the sufficient superheat to the MT compressor 128. The internal heat exchanger 126 facilitates the heat change between these two refrigerant streams. This, in turn, leads the superheat of the refrigerant at the suction line of the MT compressor 128 which may avoid the wet vapor entry of the MT compressor 128. The internal heat exchanger 126 provides the refrigerant to the MT compressor 128 via the outlet 140*d*. The internal heat exchanger 126 provides the refrigerant flown from the check valve 124 to the flash tank 112 via the outlet 140*b*. Additionally, the internal heat exchanger 126 may reduce unnecessary refrigerant flashing into gas in the flash tank 112.

The MT compressor 128 may be a variable speed compressor or a multiple-stage compressor and generally configured to compress (e.g., increase the pressure of) the refrigerant received from the internal heat exchanger 126. The MT compressor 128 may be configured to compress refrigerant from medium-temperature applications, such as for display items, by increasing the refrigerant pressure. The MT compressor 128 is fluidly coupled with the refrigerant conduit subsystem 102 and positioned downstream of the internal heat exchanger 126. The MT compressor 128 is in signal communication with the controller 150 using wired and/or wireless connections. The controller 150 may communicate electronic signals to the MT compressor 128 to control the variable speed compressor's speed or turn on and off fixed speed compressors to maintain a constant or substantially constant suction pressure target (e.g., the target pressure level 162). A variable-speed compressor is generally configured to operate at different speeds to increase the pressure of the refrigerant to keep the refrigerant moving along the fluid conduit subsystem 102. In the variable-speed compressor configuration, the speed of MT compressor 128 can be modified to adjust the cooling capacity and/or load of the refrigeration system 100. Meanwhile, in the multi-stage compressor configuration, one or more compressors can be turned on or off to adjust the cooling capacity of the refrigeration system 100. In some embodiments, the controller 150 may control the speed of the MT compressor 128 via a variable speed drive component that is configured to translate electronic control signals into frequency adjustments (e.g., in terms of Hertz). For example, the variable speed drive component receives signals from the controller 150 to increase or decrease the frequency of the electrical power supplied to the MT compressor 128, which in turn regulates the compressor's speed.

The pressure sensor circuit 130 may include a pressure sensing element and circuitry. The pressure sensor circuit 130 may be implemented by a hardware circuit configured to detect the pressure of the refrigerant at the inlet of the MT compressor 128. The pressure sensor circuit 130 may include one or more pressure sensor circuits 130. The pressure sensor circuit 130 may include a pressure sensing element, such as a diaphragm, a piezoelectric sensor, and/or any other type of pressure sensing circuit boards. The pressure sensor circuit 130 may be attached to a surface of the inlet of the MT compressor 128 using any appropriate means (e.g., threaded connections, clamps, adhesives, or the like). The pressure sensor circuit 130 is configured to detect (capture) the pressure 166 of the refrigerant periodically (e.g., every second, every minute, etc.) and/or on demand (e.g., in response to a request from a user provided to the controller 150 or a control panel). The pressure sensor circuit 130 is in signal communication with the controller 150 using wired and/or wireless connections. The pressure sensor circuit 130 may provide pressure data 164 that includes the detected pressure 166 of the refrigerant to the controller 150. The controller 150 may use the pressure data 164 for evaluating the system conditions. This process is described further below in conjunction with the operational flow of the system 100 in greater detail.

The outdoor heat exchanger 132 may be a high-side heat exchanger, such as a gas cooler or a condenser, and generally includes one or more coils and fans to move the air across the coils. The outdoor heat exchanger 132 is fluidly coupled with the refrigerant conduit subsystem 102 and positioned downstream of the MT compressor 128 and upstream of the valve 136. The outdoor heat exchanger 132 is in signal communication with the controller 150 using wired and/or wireless connections. The controller 150 may send electronic signals to the outdoor heat exchanger 132 to control the speed of the fans based on temperature conditions and conditioning demand. The outdoor heat exchanger 132 is configured to transfer heat from the refrigerant into the surrounding outdoor environment. The outdoor heat exchanger 132 removes heat from the refrigerant when the refrigerant flows through the coils, allowing the refrigerant to release its absorbed heat into the outdoor environment. When heat is removed from the refrigerant, the refrigerant is cooled. The outdoor heat exchanger 132 may be operated as a condenser and/or a gas cooler. When operating as a condenser, outdoor heat exchanger 132 cools the refrigerant such that the state of the refrigerant changes from a gas to a liquid. When operating as a gas cooler, outdoor heat exchanger 132 cools gaseous refrigerant and the refrigerant remains a gas. In certain configurations, the outdoor heat exchanger 132 is positioned such that heat removed from the refrigerant may be discharged into the air in the surrounding environment. For example, the outdoor heat exchanger 132 may be positioned on a rooftop so that heat removed from the refrigerant may be discharged into the air. As another example, the outdoor heat exchanger 132 may be positioned external to a building and/or on the side of a building. This disclosure contemplates any suitable refrigerant (e.g., carbon dioxide) being used in the disclosed cooling systems. The refrigeration system 100 may include any appropriate number of outdoor heat exchangers 132 with the same or a similar configuration to that shown for the example of the outdoor heat exchanger 132 in FIG. 1.

The thermostat 134 may be located within the conditioned space (e.g., a room or building) serviced by the refrigeration system 100. In some embodiments, the controller 150 may be separate from or integrated within the thermostat 134. The thermostat 134 is configured to allow a user to input a desired temperature or baseline setpoint temperature for the conditioned space. In some embodiments, the thermostat 134 includes a user interface 142 and display 144 for displaying information related to the operation and/or status of the refrigeration system 100. For example, the user interface 142 may communicate with the display 144 to show operational, diagnostic, and/or status messages and provide a visual interface that allows at least one of an installer, a user, a support entity, and a service provider to perform actions with respect to the refrigeration system 100. For example, the user interface 142 may communicate with the display 144 to show messages related to the status and/or operation of the refrigeration system 100. The user interface 142 may include user interface components to interact with users, e.g., receive a desired temperature for the target space, among others.

The valve 136 may be an expansion valve, a high-pressure valve, a motorized valve, a solenoid valve, an EEV, a TXV, or any other suitable valve configured to control the flow of the refrigerant. The valve 136 is fluidly coupled with the refrigerant conduit subsystem 102 and positioned downstream of the outdoor heat exchanger 132 and upstream of the flash tank 112. The valve 136 is in signal communication with the controller 150 using wired and/or wireless connections. The valve 136 may be configured to receive the refrigerant discharged from the outdoor heat exchanger 132 and reduce the pressure of the received refrigerant before it reaches the flash tank 112. The valve 136 may regulate the pressure of the refrigerant. In this process, the opening of the valve 136 may be adjusted to control the flow of the refrigerant and the pressure drop of the refrigerant as it transitions from the high-pressure side after the outdoor heat exchanger 132 to the lower pressure in the flash tank 112. The valve 136 may have a throttle that can open or close to varying degrees to control the flow rate of the refrigerant. By narrowing the passage of the valve 136, the valve 136 increases resistance to the refrigerant flow rate, which causes an increase in the pressure drop. By opening the passage of the valve 136, the valve 136 reduces the resistance to the refrigerant flow rate, which reduces the pressure drop.

The controller 150 is communicatively coupled (e.g., via wired and/or wireless connection) to other components in the refrigeration system 100 and configured to control their operations. In some embodiments, controller 150 can be one or more controllers associated with one or more components of the refrigeration system 100. The controller 150 includes a processor 152 in signal communication with a memory 156 and an input/output (I/O) interface 154. The processor 152 comprises one or more processors. The processor 152 is any electronic circuitry including, but not limited to, state machines, one or more central processing unit (CPU) chips, logic units, cores (e.g., a multi-core processor), field-programmable gate array (FPGAs), application-specific integrated circuits (ASICs), or digital signal processors (DSPs) that communicatively couples to memory 156 and controls the operation of refrigeration system 100. The processor 152 may be a programmable logic device, a microcontroller, a microprocessor, or any suitable combination of the preceding. The processor 152 is communicatively coupled to, and in signal communication with, the memory 156. The one or more processors are configured to process data and may be implemented in hardware or software. For example, the processor 152 may be 8-bit, 16-bit, 32-bit, 64-bit or of any other suitable architecture. The processor 152 may include an arithmetic logic unit (ALU) for performing arithmetic and logic operations, processor registers that supply operands to the ALU and store the results of ALU operations, and a control unit that fetches instructions from memory 156 and executes them by directing the coordinated operations of the ALU, registers, and other components. The processor 152 may include other hardware and software that operates to process information, control the refrigeration system 100, and perform any of the functions described herein. The processor 152 may be configured to execute software instructions to perform operations of the controller 150. For example, the processor 152 may be configured to execute the software instructions 158 to cause the refrigeration system 100 to perform one or more of its operations described herein. The processor 152 may execute code/software instructions 158 to perform any of its operations. The processor 152 is not limited to a single processing device and may encompass multiple processing devices. The processor 152 may be configured to perform one or more operations of the controller 150 described in FIG. 1 and one or more operations of the method 200 described in FIG. 2.

The memory 156 may be a non-transitory computer-readable medium. The memory 156 may include one or more disks, tape drives, or solid-state drives, and may be used as an overflow data storage device, to store programs when such programs are selected for execution, and to store instructions and data that are read during program execution. The memory 156 may be volatile or non-volatile and may comprise a read-only memory (ROM), random-access memory (RAM), ternary content-addressable memory (TCAM), dynamic random-access memory (DRAM), and static random-access memory (SRAM). The memory 156 is operable to store any suitable set of instructions, logic, rules, and/or code for executing the functions described in this disclosure. For example, the memory 156 may store and retrieve information corresponding to software instructions 158, electronic signals 160*a-d*, target pressure level 162, pressure data 164, temperature data 168, target pressure differential 174, and pressure differential 172, and/or other data, instructions, and operating parameters for components in the system 100.

The I/O interface 154 is configured to communicate data and signals with other devices. For example, the I/O interface 154 may be configured to communicate electrical signals with the other components of the refrigeration systems 100. The I/O interface 154 may comprise ports and/or terminals for establishing signal communications between the controller 150 and other devices. The I/O interface 154 may be configured to enable wired and/or wireless communications. Connections between various components of the refrigeration system 100 and between components of system 100 may be wired or wireless. For example, conventional cables and contacts may be used to couple the thermostat 134 to the controller 150 and various components of the refrigeration system 100.

In some embodiments, a wireless connection may be employed to provide at least some or all of the connections between components of the refrigeration system 100. In some embodiments, a data bus may couple various components of the refrigeration system 100 together such that data is communicated therebetween. In some embodiments, the data bus may include, for example, any combination of hardware, software embedded in a computer-readable medium, or encoded logic incorporated in hardware or otherwise stored (e.g., firmware) to couple components of the refrigeration system 100 to each other.

As an example and not by way of limitation, the data bus may include an accelerated graphics port (AGP) or other graphics bus, a controller area network (CAN) bus, a front-side bus (FSB), a hypertransport (HT) interconnect, an InfiniBand™ interconnect, a low-pin-count (LPC) bus, a memory bus, a micro channel architecture (MCA) bus, a peripheral component interconnect (PCI) bus, a PCI-Express (PCI-X) bus, a serial advanced technology attachment (SATA) bus, a video electronics standards association local bus (VLB), or any other suitable bus or a combination of two or more of these. In various embodiments, the data bus may include any number, type, or configuration of data buses, where appropriate. In certain embodiments, one or more data buses (which may each include an address bus and a data bus) may couple the controller 150 to other components of the refrigeration system 100.

Operational Flow for Operating the Refrigeration System

In operation, the refrigeration system 100 may provide air conditioning to the target space(s) by circulating the refrigerant through various components of the refrigeration system 100 as shown by the arrows in the example of FIG. 1. The operational flow of the refrigeration system 100 may begin when the conditioning demand is received. For example, the controller 150 may receive the request to provide air conditioning with respect to the target space from the thermostat 134 when a user sets a desired temperature on the interface 142.

At any point during the operation of the refrigeration system 100, the controller 150 may receive the temperature data 168 from the temperature sensor circuit 118 and determine whether the temperature 170 of the target space corresponds to the desired temperature indicated by the conditioning demand. If the temperature 170 of the target space does not correspond to the desired temperature, the controller 150 may continue to operate the LT compressor 120 and the MT compressor 128 until the target temperature is achieved.

In response to receiving the air conditioning demand, the controller 150 may communicate a first electronic signal 160*a* to the MT compressor 128 to activate the MT compressor 128. The first electronic signal 160*a* may be configured to activate the MT compressor 128. In response to the MT compressor 128 being activated, the refrigerant may be circulated through the refrigeration system 100 until the air conditioning demand is met. Further, in response to receiving the air conditioning demand, the controller 150 may communicate a second electronic signal 160*b* to the LT compressor 120 to activate the LT compressor 120. The second electronic signal 160*b* may be configured to activate the LT compressor 120. In response to the LT compressor 120 being activated, the LT compressor 120 pulls or draws in the refrigerant from the indoor heat exchanger 116. When the refrigerant flows through the coils of the indoor heat exchanger 116, it absorbs heat from the target space, which in turn, cools the target space. In response, the LT compressor 120 may compress the refrigerant received from the indoor heat exchanger 116 into a higher pressure and temperature refrigerant.

The LT compressor 120 may provide the refrigerant to the oil separator 122. In cases where the oil from within the LT compressor 120 is mixed with the refrigerant, the oil separator 122 may separate the oil from the refrigerant and circulate the oil back to the compressors for lubrication. Subsequently, the refrigerant flows from the oil separator 122 to the internal heat exchanger 126 via the inlet 140*a* after passing through the check valve 124. The check valve 124 operates to allow refrigerant flow when there is a target pressure differential 174 between the LT compressor 120's discharge line and the MT compressor 128's suction line. The check valve 124 operates based on a pre-set target pressure differential 174 between the LT compressor 120's discharge line and the MT compressor 128's suction line. Specifically, the check valve 124 is configured to allow refrigerant to flow when the pressure at the LT compressor 120's discharge line is higher than the MT compressor 128's suction pressure by the target pressure differential 174. The check valve 124 may function autonomously to open or close as needed to maintain the specified target pressure differential 174. The target pressure differential 174 may be mechanically calibrated within the check valve 124 to allow it to open when the LT discharge pressure is sufficiently higher than the MT suction pressure by the target pressure differential 174 and to close otherwise.

When the refrigerant flows into the internal heat exchanger 126, it exchanges heat with the vapor refrigerant received from the flash tank 112. The heat exchange process cools the refrigerant from the LT compressor 120 and warms the vapor refrigerant from the flash tank 112, which provides the sufficient superheat at the MT compressor's suction line and the thermal load on the MT compressor 128. The refrigerant flows from the outlet 140*b* of the internal heat exchanger 126 to the flash tank 112. The flash tank 112, in turn, provides cooled gas refrigerant to the internal heat exchanger 126. The refrigerant flows from the outlet 140*d* of the internal heat exchanger 126 to the suction line of the MT compressor 128.

The MT compressor 128 pulls in the conditioned refrigerant from the internal heat exchanger 126 and compresses it, which increases the temperature and pressure of the refrigerant. The compressed refrigerant flows from the MT compressor 128 through the outdoor heat exchanger 132 to dissipate heat into the outdoor environment. The refrigerant then flows towards the valve 136 which reduces the pressure of the refrigerant received from the outdoor heat exchanger 132 before it enters the flash tank 112. This operational cycle continues and the controller 150 adjusts the speed of the MT compressor 128 based on the pressure at the MT suction line to maintain a refrigerant flow according to the target pressure level 162, while the LT compressor 120 continues operation to meet the cooling demand in the conditioned space.

At any point during the operation of the refrigeration system 100, the controller 150 may evaluate the pressure level of the refrigerant at the MT compressor 130's suction line. To this end, the controller 150 may monitor the pressure 166 of the refrigerant at the MT compressor 130's suction line by receiving pressure data 164 from the pressure sensor circuit 130. In response, the controller 150 may determine whether the pressure 166 of the refrigerant at the MT compressor 130's suction line corresponds to the target pressure level 162. If the pressure 166 of the refrigerant deviates from the target pressure level 162 by more than a threshold range (e.g., by more than 0.1 bar, 0.2 bar, etc.; by more than 1.45 PSI, 2.90 PSI, etc.; or by more than 0.01 MPa, 0.02 MPa, etc.), the controller 150 may adjust the speed of the MT compressor 128 to regulate the refrigerant flow and bring the pressure of the refrigerant close to the target pressure level 162. To this end, if the detected pressure 166 of the refrigerant is more than the target pressure level 162, the controller 150 may communicate a third electronic signal 160*c* to increase the speed of the MT compressor 128 until the pressure level of the refrigerant at the inlet of the MT compressor reaches the target pressure level. The third electronic signal 160*c* may cause the MT compressor 128 to adjust its speed incrementally as needed, based on the pressure deviation from the target pressure level 162 at the MT suction line. If the detected pressure 166 of the refrigerant is less than or equal to the target pressure level 162, the controller 150 may communicate a fourth electronic signal 160*d* to the MT compressor 128 to decrease its speed until the pressure level of the refrigerant at the inlet of the MT compressor reaches the target pressure level. The fourth electronic signal 160*d* may cause the speed of MT compressor 128 to incrementally decrease, e.g., by 10-50 revolutions per minute (RPM).

Example Method for Operating a Refrigeration System

FIG. 2 illustrates a flowchart of an example method 200 of operating the system 100 of FIG. 1. The method 200 may be performed by the controller 150 (see FIG. 1) when one or more processors (e.g., processor 152 of FIG. 1) execute software instructions (e.g., software instructions 158) stored in one or more memories (e.g., memory 156 of FIG. 1). The method 200 may include operations 202-214. Modifications, additions, or omissions may be made to method 200. Method 200 may include more, fewer, or other operations. For example, operations may be performed in parallel or in any suitable order.

At operation 202, the controller 150 may receive a conditioning demand with respect to a target space, similar to that described in FIG. 1.

At operation 204, the controller 150 may communicate a first electronic signal 160*a* to the MT compressor 128 to activate the MT compressor 128, similar to that described in FIG. 1.

At operation 206, the controller 150 may communicate a second electronic signal 160*b* to an LT compressor 120 to activate the LT compressor 120, similar to that described in FIG. 1.

At operation 208, the controller 150 receives a pressure level (e.g., pressure 166) of refrigerant at the inlet of the MT compressor 128, similar to that described in FIG. 1.

At operation 210, the controller 150 may determine whether the refrigerant pressure level is more than the target pressure level 162, similar to that described in FIG. 1. If it is determined that the refrigerant pressure level is more than the target pressure level 162, the method 200 proceeds to operation 212. Otherwise, the method 200 proceeds to operation 214.

At operation 212, the controller 150 communicates a third electronic signal 160*c* to the MT compressor 128 to increase its speed until the pressure level of the refrigerant at the inlet of the MT compressor 128 reaches the target pressure level 162, similar to that described in FIG. 1.

At operation 214, the controller 150 communicates a fourth electronic signal 160*d* to the MT compressor 128 to decrease its speed until the pressure level of the refrigerant at the inlet of the MT compressor 128 reaches the target pressure level 162, similar to that described in FIG. 1.

Although this disclosure has been described in terms of certain embodiments, alterations, and permutations, embodiments will be apparent to those skilled in the art. Accordingly, the above description of the embodiments does not constrain this disclosure. Other changes, substitutions, and alterations are possible without departing from the spirit and scope of this disclosure.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated with another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

What is claimed is:

1. A refrigeration system comprising:

an indoor heat exchanger positioned downstream of a flash tank, and configured to:

receive refrigerant from the flash tank; and provide air conditioning to a target space by transferring heat between the refrigerant and the target space;

a low-temperature (LT) compressor positioned downstream of the indoor heat exchanger, and configured to:

receive the refrigerant from the indoor heat exchanger; and compress the refrigerant received from the indoor heat exchanger;

an oil separator positioned downstream of the LT compressor, and configured to:

receive the refrigerant from the LT compressor;

separate oil from the refrigerant received from the LT compressor; and circulate the separated oil back to the LT compressor and a medium-temperature (MT) compressor;

a check valve positioned downstream of the oil separator, and configured to allow a flow of the refrigerant from the oil separator toward an internal heat exchanger;

the internal heat exchanger positioned downstream of the check valve, and configured to transfer heat from the refrigerant discharged from the LT compressor to the refrigerant received from a flash tank;

the flash tank positioned downstream of the check valve, and configured to store a mixture of the refrigerant in vapor form and liquid form, wherein the refrigerant in vapor form is provided to the internal heat exchanger and the refrigerant in liquid form is provided to the indoor heat exchanger;

the MT compressor positioned downstream of the internal heat exchanger, and configured to:

receive the refrigerant from the internal heat exchanger; and compress the refrigerant received from the internal heat exchanger; and an outdoor heat exchanger positioned downstream of the MT compressor, and configured to transfer heat from the refrigerant discharged from the MT compressor to surrounding environment.

2. The refrigeration system of claim 1, further comprising a controller, communicatively coupled with the MT compressor, the LT compressor, and comprising a processor configured to:

receive an air conditioning demand with respect to the target space; and communicate a first electronic signal to the MT compressor to activate the MT compressor, wherein in response to the MT compressor being activated, the refrigerant is circulated through the refrigeration system until the air conditioning demand is met.

3. The refrigeration system of claim 2, further comprising a pressure sensor circuit positioned at an inlet of the MT compressor, and configured to capture a pressure level of the refrigerant at the inlet of the MT compressor;

wherein the processor is further configured to:

receive the pressure level of the refrigerant from the pressure sensor circuit;

determine whether the received pressure level is more than a target pressure level; and in response to determining that the received pressure level is more than the target pressure, communicate a second electronic signal to the MT compressor to increase a speed of the MT compressor until the pressure level of the refrigerant at the inlet of the MT compressor reaches the target pressure level.

4. The refrigeration system of claim 3, wherein the processor is further configured to communicate a third electronic signal to the MT compressor to decrease the speed of the MT compressor until the pressure level of the refrigerant at the inlet of the MT compressor reaches the target pressure level in response to determining that the received pressure level is less than the target pressure level.

5. The refrigeration system of claim 1, further comprising an expansion valve positioned downstream of the outdoor heat exchanger, and configured to reduce a pressure of the refrigerant received from the outdoor heat exchanger before entering the flash tank.

6. The refrigeration system of claim 1, wherein the check valve is further configured to maintain a target pressure differential between a suction line of the MT compressor and a discharge line of the LT compressor.

7. The refrigeration system of claim 1, wherein the check valve is a unidirectional valve that prevents the flow of the refrigerant towards the oil separator.

8. A method for operating a refrigeration system, comprising:

receiving, by an indoor heat exchanger positioned downstream of a flash tank, refrigerant from the flash tank;

providing, by the indoor heat exchanger, air conditioning to a target space by transferring heat between the refrigerant and the target space;

receiving, by an indoor heat exchanger positioned downstream of a flash tank, the refrigerant from the flash tank;

providing, by the indoor heat exchanger, air conditioning to a target space by transferring heat between the refrigerant and the target space;

receiving, by a low-temperature (LT) compressor positioned downstream of the indoor heat exchanger, the refrigerant from the indoor heat exchanger;

compressing, by the LT compressor, the refrigerant received from the indoor heat exchanger;

directing, by the LT compressor, the refrigerant from the LT compressor to an oil separator positioned downstream of the LT compressor;

separating, by the oil separator, oil from the refrigerant received from the LT compressor;

circulating, by the oil separator, the separated oil back to the LT compressor and a medium-temperature (MT) compressor;

allowing, by a check valve positioned downstream of the oil separator, a flow of the refrigerant from the oil separator toward an internal heat exchanger;

transferring, by the internal heat exchanger positioned downstream of the check valve, heat from the refrigerant discharged from the LT compressor to the refrigerant received from the flash tank;

storing, by the flash tank positioned downstream of the check valve, a mixture of the refrigerant in vapor form and liquid form, wherein:

the flash tank provides the refrigerant in vapor form to the internal heat exchanger, and the flash tank provides the refrigerant in liquid form to the indoor heat exchanger;

receiving, by the medium-temperature (MT) compressor positioned downstream of the internal heat exchanger, the refrigerant from the internal heat exchanger;

compressing, by the MT compressor, the refrigerant received from the internal heat exchanger; and transferring, by an outdoor heat exchanger positioned downstream of the MT compressor, heat from the refrigerant discharged from the MT compressor to a surrounding environment.

9. The method of claim 8, further comprising:

receiving, by a processor, an air conditioning demand with respect to the target space; and communicating, by the processor, a first electronic signal to the MT compressor to activate the MT compressor, wherein in response to the MT compressor being activated, the refrigerant is circulated through the refrigeration system until the air conditioning demand is met.

10. The method of claim 9, further comprising:

receiving, by the processor, a pressure level of the refrigerant from a pressure sensor circuit positioned at an inlet of the MT compressor;

determining, by the processor, whether the received pressure level is more than a target pressure level; and in response to determining that the received pressure level is more than the target pressure, communicating, by the processor, a second electronic signal to the MT compressor to increase a speed of the MT compressor until the pressure level of the refrigerant at the inlet of the MT compressor reaches the target pressure level.

11. The method of claim 10, further comprising communicating, by the processor, a third electronic signal to the MT compressor to decrease a speed of the MT compressor until a pressure level of the refrigerant at the inlet of the MT compressor reaches the target pressure level in response to determining that the received pressure level is less than the target pressure level.

12. The method of claim 8, further comprising reducing, by an expansion valve positioned downstream of the outdoor heat exchanger, a pressure of the refrigerant received from the outdoor heat exchanger before entering the flash tank.

13. The method of claim 8, wherein the check valve is further configured to maintain a target pressure differential between a suction line of the MT compressor and a discharge line of the LT compressor.

14. The method of claim 8, wherein the check valve is a unidirectional valve that prevents the flow of the refrigerant towards the oil separator.

15. A controller for a refrigeration system, the controller comprising:

a processor communicatively coupled to a medium-temperature (MT) compressor and a pressure sensor circuit; wherein the processor is configured to:

receive an air conditioning demand for a target space;

communicate a first electronic signal to the MT compressor to activate the MT compressor, wherein, in response to the MT compressor being activated, the refrigerant is circulated through the refrigeration system until the air conditioning demand is met;

receive a pressure level of the refrigerant from the pressure sensor circuit positioned at an inlet of the MT compressor;

determine whether the received pressure level is more than a target pressure level; and in response to determining that the received pressure level is more than the target pressure, communicate a second electronic signal to the MT compressor to increase a speed of the MT compressor until the pressure level of the refrigerant at the inlet of the MT compressor reaches the target pressure level.

16. The controller of claim 15, wherein the processor is further configured to communicate a third electronic signal to the MT compressor to decrease the speed of the MT compressor until the pressure level of the refrigerant at the inlet of the MT compressor reaches the target pressure level in response to determining that the received pressure level is less than the target pressure level.

17. The controller of claim 15, wherein the MT compressor is positioned downstream of an internal heat exchanger and configured to:

receive the refrigerant from the internal heat exchanger; and compress the refrigerant received from the internal heat exchanger.

18. The controller of claim 15, wherein the pressure sensor circuit is positioned at an inlet of the MT compressor, and configured to capture the pressure level of the refrigerant at the inlet of the MT compressor.

19. The controller of claim 15, wherein the refrigerant is flown from an oil separator towards a flash tank via a check valve based on a target pressure differential between a discharge line of a low-temperature (LT) compressor and a suction line of the MT compressor.

20. The controller of claim 19, wherein the check valve is configured to maintain a target pressure differential between a suction line of the MT compressor and a discharge line of the LT compressor.

* * * * *